United States Patent [19]

Landry et al.

[11] Patent Number: 5,015,401

[45] Date of Patent: May 14, 1991

[54] BEARINGS GREASE FOR ROCK BIT BEARINGS

[75] Inventors: David K. Landry, Westminster, Colo.; Terry J. Koltermann, Pasadena, Tex.

[73] Assignee: Hughes Tool Company, Houston, Tex.

[21] Appl. No.: 599,271

[22] Filed: Oct. 16, 1990

[51] Int. Cl.[5] ..... C10M 125/18; C10M 125/22

[52] U.S. Cl. ..... 252/18; 175/227

[58] Field of Search ..... 252/18; 175/227

[56] References Cited

U.S. PATENT DOCUMENTS

| | | | |
|---|---|---|---|
| 3,170,878 | 2/1965 | Armstrong | 252/18 |
| 3,344,065 | 9/1967 | Gansheimer et al. | 252/18 |
| 3,652,414 | 3/1972 | Bergeron . | |
| 3,705,450 | 12/1972 | Morisaki . | |
| 3,746,352 | 7/1973 | Bao et al. . | |
| 3,935,114 | 1/1976 | Donaho, Jr. . | |
| 4,358,384 | 11/1982 | Newcomb . | |
| 4,434,063 | 2/1984 | Kageyama et al. | 252/25 |

FOREIGN PATENT DOCUMENTS 0191608 8/1986 European Pat. Off. .

OTHER PUBLICATIONS

Robert L. Fusaro and Harold E. Sliney, Graphite Fluoride—A New Solid Lubricant.

*Primary Examiner*—Prince E. Willis
*Assistant Examiner*—Jerry D. Johnson
*Attorney, Agent, or Firm*—Charles D. Gunter, Jr.

[57] ABSTRACT

A heavy duty lubricating grease as shown which includes a multi-purpose heavy duty hydrocarbonaceous lubricant thickened by an alkaline soap to form a lubricating grease, molybdenum disulfide and powdered calcium fluoride. The heavy duty grease can be used in a journal bearing of a drill bit in heavy duty, high temperature applications, such as journal bearings on its used to drill hot subterranean formations.

8 Claims, 1 Drawing Sheet

11
17
13
29
15
31
23
45
43
27
37
25
33
19
21
41
39

BEARINGS GREASE FOR ROCK BIT BEARINGS

This application is a continuation of application Ser. No. 408,809, filed Sept. 18, 1989, now abandoned.

BACKGROUND OF THE INVENTION

1. Field of the Invention

This invention relates to grease compositions and, specifically, to a grease designed for use in heavy duty, high temperature applications, such as for journal bearings on bits used to drill hot subterranean formations.

2. Description of the Prior Art

A variety of grease compositions have been employed in rock bits in the past. Such grease compositions typically comprise a high viscosity, refined petroleum or hydrocarbon oil which provides the basic lubricity of the composition and may constitute about ¾ of the total grease composition as the oil is thickened with a metal soap or metal complex soap, wherein the metal is typically aluminum, barium, calcium, lithium, sodium or strontium. Complex-thickened greases are well known in the art and are discussed, for example, in Encyclopedia of Chemical Technology, Kirk-Othmer, 2nd Edition, A. Standen, Editor, Interscience Publishers, John Wiley & Sons, Inc., New York, N.Y., 1967, pages 582–587. It is also known to employ certain complexes, such as the calcium-acetate containing complexes and the lithium-hydroxy-stearate-containing complexes; to provide high temperature stability and maintain lubrication properties at the high temperatures to which the greases may be subjected.

The grease utilized to lubricate a rock bit of the type used to drill hot (frequently over 300° F.) subterranean formations is subjected to severe and demanding constraints. The drilling takes place in an abrasive atmosphere of drilling mud and rock particles thousands of feet from the engineer or supervisor, who does not have benefit of oil pressure gauges or temperature sensors at the surfaces to be lubricated. The lubricant must possess properties which enable flow-through passageways to the surfaces to be lubricated and must prevent solid lubricant particles from settling out.

The prior art shows solid extreme pressure (EP) additives which have been employed to attempt to enhance the lubrication of properties of oils and greases. For example, molybdenum disulfide has been used in a wide variety of lubricants as discussed in U.S. Pat. Nos. 3,062,741; 3,170,878; 3,281,355; and 3,384,582 other solid additives include copper, lead and graphite.

It is also known to include metallic oxides like zinc oxide in lubrication oils. U S. Pat. No. 2,736,700 describes the use of molybdenum disulfide and a metallic oxide such as a fumed lead oxide and zinc oxide in a ratio of 2 parts molybdenum disulfide to 1 part metallic oxide, in a paint-on composition, or bonded lubricant, containing a lacquer drying agent. Such bonded lubricants are used for drawing tough metals, such as uranium, thorium, zinc and titanium. Such bonded lubricants are inadequate and could not be used in the low wear, heavily loaded applications for which this invention is intended.

U.S. Pat. No. 3,935,114 teaches the use of molybdenum disulfide and antimony trioxide in a lubricating grease for a journal bearing used in a drill bit. This grease has proved particularly effective when used in copper inlay-on-boronized bearings of rock bits.

The prior art also includes the use of fluorides of sodium, potassium and calcium as matrix materials in the surface layer of a dry bearing structure, particularly for aerospace applications. These fluorides were used in composite structures and were typically applied to the bearing surface by plasma spray, see e.g. U.S. Pat. No. 3,746,352. To our knowledge, calcium fluoride has not been used previously as a component of a grease to provide improved bearing performance particularly in rock bit bearings.

A need exists for a bearing grease with superior lubricating properties that can be employed in the application of lubricating journal bearings and bits drilling in an abrasive atmosphere.

A need also exists for a low wear grease which can be used with rock bit bearings to provide extended wear life and load carrying capacity.

SUMMARY OF THE INVENTION

Accordingly, it is an object of this invention to provide a grease that is temperature stable and which can be employed under severe and demanding conditions, such as, for lubricating journal bearings of bits penetrating subterranean formations, by providing a degree of protection not heretofore available at the extreme pressure and high temperature conditions to which the lubricant will be subjected.

Another object of the invention is to provide a grease with physical properties, such as a worked penetration, sufficient to flow to the surfaces to be lubricated; and not flow out of the bit but to provide lubrication and protection greater than available heretofore at temperatures in excess of 300° F.

These and other objects will become apparent in the following written description.

The superior grease of the invention comprises:

(a) a multi-purpose heavy duty hydrocarbonaceous lubricant thickened by an alkaline soap to form a lubricating grease;

(b) powdered molybdenum disulfide; and (c) powdered calcium fluoride.

A particularly preferred grease comprises a lubricating grease of the type described containing 3 to 30% by weight of the grease of total solids, i.e., molybdenum disulfide plus calcium fluoride.

DETAILED DESCRIPTION OF THE INVENTION

Figure 1:
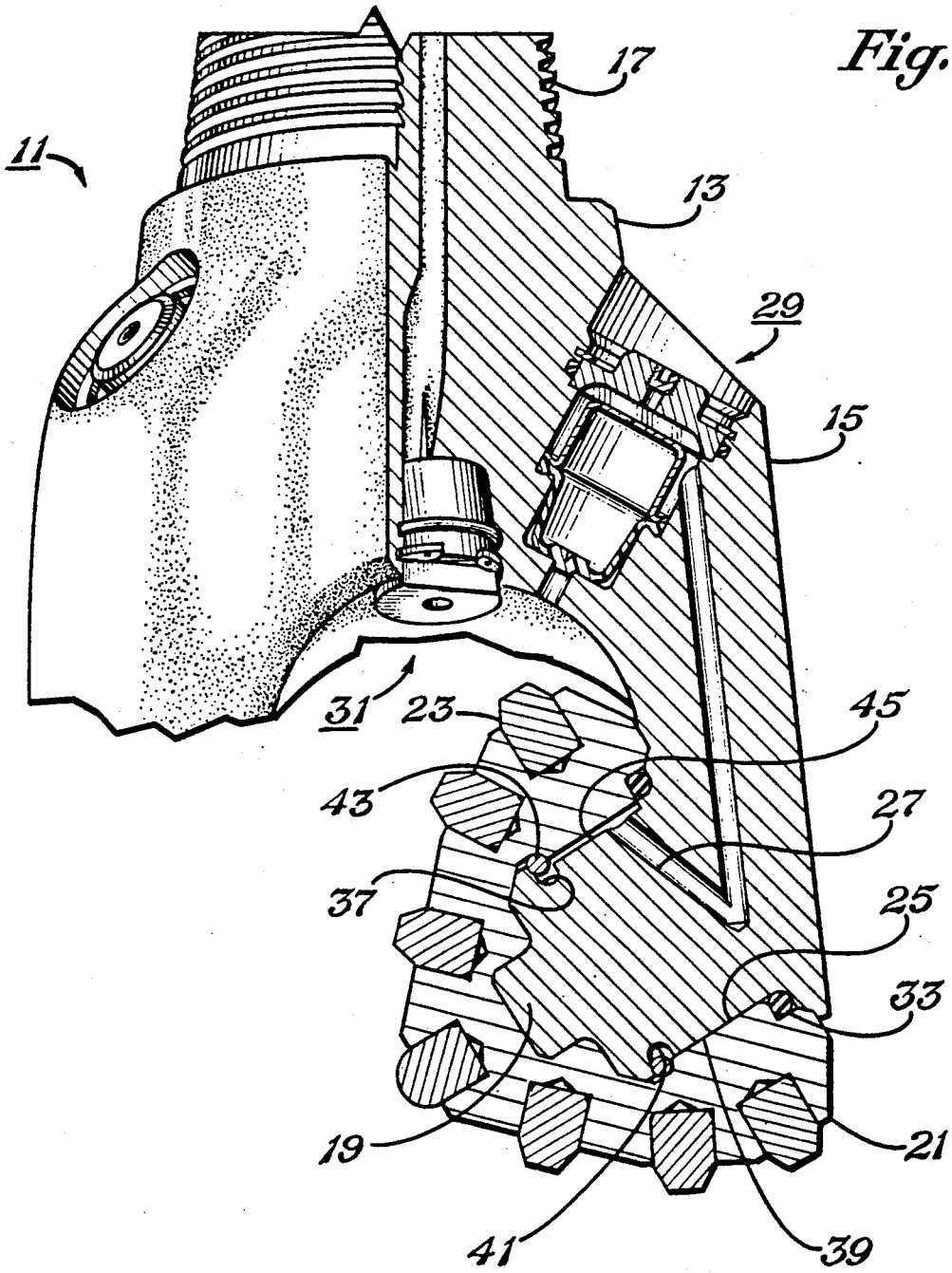
FIG. 1 is a side, perspective view of an earth boring drill bit which receives the lubricating grease of the invention, partly in section and partly broken away.

The grease of the invention, with its superior lubricating properties, is prepared by dispersing uniformly in a conventional high temperature, alkaline soap thickened lubricating grease, a desired effective and synergistic amount of molybdenum disulfide and calcium fluoride solids.

The "lubricating grease" is used herein to denote a high temperature, multi-purpose heavy duty hydrocarbonaceous lubricant that has been thickened by an alkaline soap. A suitable grease composition is made from a base high viscosity, refined petroleum or hydrocarbon oil which is thickened with an alkaline metal soap or metal soap complex, wherein the metal is typically aluminum, barium, calcium, lithium, sodium or strontium, preferably a calcium complex, such as calcium acetate.

Preferably, the lubricating grease has an ASTM D-217 test, in depths of penetration in tenths of a millimeter in 5 seconds at 77° F., of no less than 265. The lubricating grease has a National Lubricating Grease Institute (NLGI) classification of less than class 3 to effect the requisite flow through passageways to reach and to lubricate the surfaces of interfacing elements, such as bearings. Thus, the lubricating grease falls in the NLGI class 00, class 0, class 1, or class 2. The method of dispersion and the NLGI table of classification, including physical properties for the classes, is included in the above-referenced Encyclopedia of Chemical Technology. The most preferred greases employ a calcium complex type of thickener that contains calcium acetate as a primary ingredient. A suitable lubricating grease has the specifications set forth in Table I.

TABLE I

| Property | High Temperature Grease |
|---|---|
| Worked Penetration; 60 strokes at 77° F. | 325 |
| Viscosity of oil at 100° F., SSU | 600 |
| Timken EP, lbs. pass | 50 |
| Drop point °F. | 568 |
| Texture | Buttery Smooth |
| Color | Beige |
| % by wt. oil | 73.55 |
| NLGI grade | 1 |

Other calcium-acetate-complex thickened greases are described in U.S. Pat. Nos. 2,999,065 and 2,999,066. A lubricating grease which is selected should have lubricating properties, before addition of the solid additives, typically sufficient to provide a shell 4-ball EP scar diameter of 1.3 millimeters (mm) maximum after 5 minutes (min.) at 900 revolutions per minute (rpm) under 200 kilogram load (kg).

The particular molybdenum disulfide selected should be small enough to pass 100% through a 100 mesh per inch screen and preferably will pass 100% through a 325 mesh screen such that it may be easily and substantially uniformly dispersed throughout the lubricating grease. A satisfactory commercial grade of molybdenum disulfide is available from Climax Molybdenum Company as "Molysulfide Technical Fine Grade" and has a medium particle size of 3–6 um and a bulk density of 0.4 gm/cm$^3$.

The powdered calcium fluoride can be obtained from a number of commercial suppliers and is preferably small enough to pass 100% through a 100 mesh screen and is most preferably small enough to pass 100% through a 325 mesh screen such that the calcium fluoride can be readily and substantially uniformly dispersed in the lubricating grease.

The molybdenum disulfide and calcium fluoride can be incorporated into the grease at almost any stage in the manufacture of the final product, depending upon the convenience with respect to the particular manufacturer. For example, they can be incorporated when the thickener is added; or, ordinarily they can be incorporated at some stage in the handling of the semi-finished product. The important feature is that sufficient mixing should be employed; as by working, homogenizing, or otherwise; to secure a complete, uniform, and thorough dispersion of the particles of the molybdenum disulfide and the calcium fluoride throughout the grease.

A grease that is satisfactory for the present purposes has from about 1–20% by weight of the grease of the powdered molybdenum disulfide and from about 1–20% by weight of the grease of the powdered calcium fluoride. Preferably, the total solids content of the grease (weight percent powdered molybdenum disulfide and powdered calcium fluoride) is from about 3–30% by weight of the grease. In the laboratory test results effective solids weight percent ratio's ranged from about 1 $MoS_2$: 6 $CaF_2$ to 6 $MoS_2$: 1 $CaF_2$. In the laboratory a test employing a bearing configuration similar to that found in a rock bit was used to evaluate the lubricants. The rotational speed, temperature and radial clearance were held constant while the load was increased at set intervals. The resulting torque required to rotate the bearing was monitored continuously throughout the tests. As a measure of the various lubricants performance, a comparision was made of the measured torque in each test at an applied load of 10,000 lbs on the bearing (Table II).

TABLE II

BEARING TEST RESULTS - 166 RPM, 300° F., CARB-ON-CARB BEARINGS

| Total Solids Added (%) | Approximate Ratio Of $MoS_2/CaF_2$ Tested | Average Torque (KW) at 10 Klbs | Number of Tests | Standard Deviation ($\sigma$n-1) |
|---|---|---|---|---|
| 30 | 2:1, 1:2 | 1.1 | 2 | 0 |
| 20 to 21 | 5.7:1, 2:1, 1.1, 2:1, 1:5.7 | 1.1 | 10 | .18 |
| 14 | 2.5:1, 1:1, 1:2.5 | 1.0 | 8 | .07 |
| 10 | 2.3:1, 1:1, 1:2.3 | 1.0 | 6 | .19 |
| 6 | 2:1, 1;1, 1:2 | 1.0 | 6 | .13 |
| 4 | 3:1, 1:1, 1:3 | 1.0 | 6 | .25 |
| 10 | $MoS_2$ Only | 1.3 | 2 | .21 |
| 6 | $MoS_2$ Only | 1.5 | 2 | 0 |
| 3 | $MoS_2$ Only | 1.4 | 2 | .14 |

In laboratory bearing tests, the lower total solids contents (14% and below) performed better than higher total solids contents (20% and above). However, in actual field tests, the higher total solids contents (20% and above) produced superior results.

FIG. 1 shows portions of an earth boring drill bit 11 of the type intended to be used with the lubricating grease of the invention. The bit 11 includes a body 13 formed of 3 head sections 15 that are typically joined by a welding process. Threads 17 are formed on the top of the body 13 for connection to a conventional drill string, not shown. Each head section 15 has a cantilevered shaft or bearing pin 19 having its unsupported end oriented inward and downwardly. A general conically shaped cutter 21 is rotatably mounted on each bearing pin 19. The cutter 21 has earth disintegrating teeth 23 on its exterior and a central opening or bearing recess 25 in its interior for mounting on the bearing pin 19. Friction bearing means formed on the bearing pin 19 and cutter bearing recess 25 are connected with lubricant passage 27. A pressure compensator 29 and associated passages constitute a lubricant reservoir that limits the pressure differential between the lubricant and the ambient fluid that surrounds the bit after flowing through the nozzle means 31.

An O-ring seal 33 can be located between the bearing pin 29 and cutter 21 at the base of the bearing pin in a seal region. The O-ring 33 and seal region 35 at the base of the bearing pin 19 prevent egress of lubricant and ingress of bore hold fluid.

An annular assembly groove 37 is formed on the cylindrical surface 39 of the bearing pin 19. A registering retainer groove 41 is formed in the bearing recess 25 of the cutter 21. Grooves 37 and 41 are approximately located so that they register to define an irregularly shaped annular cavity in which is located a snap ring 43. The snap ring 43 preferably has a circular cross-section and is formed of a resilient metal. The ring 47 contains a gap at one circumferential location, so that its annular diameter may be compressed or expanded and also so that lubricant may flow past the ring.

Known rock bit bearing metallurgy combinations include carburized on carburized, copper inlay on boronized and tin or silver on boronized case combinations. The present grease can be used with particular advantage in carburized on carburized bearing configurations. Unlike those manufacturing methods which require carburizing and then boronizing the friction bearing regions of the bearing pin 19 and cutter bearing recess 25, the grease of the invention requires only that the surfaces be carburized. In addition, the use of copper inlays to further enhance the friction properties of the wear surfaces can be eliminated.

In the preferred manufacturing method of the invention, the bearing surfaces of the pin 19 and cutter recess 25 are carburized only. Carburizing techniques are known to those skilled in the art and are shown, for example, in U.S. Pat. No. 4,643,051, "Pack Carburizing Process For Earth Boring Drill Bits", issued Feb. 17, 1987. After carburizing the bearing surfaces and assembling the bit, the grease of the invention is installed within lubricant reservoir.

The following examples illustrate satisfactory greases prepared in accordance with the invention. Three 7⅞" J33C bits and three 7⅞" J44C bits were manufactured using carb-on-carb bearings and containing the grease of the invention (14% by weight $MoS_2$ and 7% by weight $CaF_2$) in one leg on each bit with the other two legs using copper inlay-on-boronized bearings and a grease as described in U.S. Pat. No. 3,935,114. A summary of the bit runs is shown in Table III. The six bits were run in the Odessa area in west Texas. The J44C bits were run with heavy weights in hard formations to test the load bearing capacity of the bearing grease of the invention. The J33C bits were run with somewhat lighter loads in relatively softer formations for extremely long hours as seen in Table III. In the J44C bits, loads ranged from 35,000 lbs to 65,000 lbs. and the length of the run ranged from 12.5 hours to 78.5 hours. In the J33C bits, loads ranged from 35,000 lbs. to 42,000 lbs. and the length of the run ranged from 50 hours to 168 hours. The experimental leg on all six bits was seal effective after each run. The unique combination of the grease of the invention and carb-on-carb bearings proved equal to or better than the standard combination of grease as shown in U.S. Pat. No. 3,935,114 and copper inlay-on-boronized bearings. The grease of the invention when used with the carb-on-carb bearing provides extended wear life and load carrying capacity. The removal of copper inlays and boronizing save several expensive steps in the manufacturing operation.

TABLE III

| Run | Location | Depth Out | Feet | Hours | Wt. | RPM |
|---|---|---|---|---|---|---|
| | | 7-⅞" J44C Bits | | | | |
| 1 | Dawson Co., Texas | 9441 | 2711 | 76 ¼ | 45/50 | 65 |
| 2 | Ector Co., Texas | 6593 | 1859 | 78 ½ | 40 | 60 |
| 3 | Surry Co., Texas | 8106 | 630 | 74 | 35 | 60 |
| 4 | Reagan Co., Texas | 7339 | 247 | 12 ½ | 65 | 80 |
| | | 7-⅞" J33C Bits | | | | |
| 1 | Garza Co., Texas | 8250 | 756 | 50 ¼ | 40/42 | 60 |
| 2 | Howard Co., Texas | 6801 | 4296 | 168 | 40 | 60 |
| 3 | Pecos Co., Texas | 3400 | 2790 | 98 | 35 | 60 |

While the invention has been described in only one of its forms, it is not thus limited but is susceptible to various changes and modifications without departing from the spirit thereof.

We claim:

1. A heavy duty lubricating grease comprising:

a multi-purpose heavy duty hydrocarbonaceous lubricant thickened by an alkaline soap to form a lubricating grease;

from about 1–20% by weight of the grease of powdered molybdenum disulfide; and from about 1–20% by weight of the grease of powdered calcium fluoride, the weight percent ratio of powdered molybdenum disulfide to powdered calcium fluoride being in the range from about 1:6 to 6:1.

2. A heavy duty lubricating grease comprising:

a multi-purpose heavy duty hydrocarbonaceous lubricant thickened by an alkaline soap to form a lubricating grease;

from about 1–20% by weight of the grease of powdered molybdenum disulfide; and from about 1–20% by weight of the grease of powdered calcium fluoride present in an effective amount, to produce a lubricating grease that is stable at temperatures up to at least 300° F. and having an ASTM worked penetration of no less than 265, and wherein the total solids content of the lubricating grease contributed by the powdered molybdenum disulfide and the powdered calcium fluoride components thereof is in the range from about 3–30% by weight of the grease, the weight percent ratio of powdered molybdenum disulfide to powdered calcium fluoride being in the range from about 1:6 to 6:1.

3. A heavy duty lubricating grease comprising:

a multi-purpose heavy duty hydrocarbonaceous lubricant thickened by a calcium complex to form a lubricating grease that is stable at temperatures up to at least 300° F. and that has an ASTM worked penetration of no less than 265;

powdered molybdenum disulfide present in the range from about 1–20% by weight of the grease; and powdered calcium fluoride present in the range from about 1–20% by weight of the grease, the weight percent ratio of powdered molybdenum disulfide to powdered calcium fluoride being in the range from about 1:6 to 6:1.

4. The heavy duty lubricating grease of claim 3, wherein the particles of molybdenum disulfide are small enough to pass 100 percent through a 100 mesh screen.

5. The heavy duty lubricating grease of claim 4, wherein the lubricating grease is in the National Lubricating Grease Institute class number lower than class 3.

6. The heavy duty lubricating grease of claim 5, wherein the molybdenum disulfide particles are small enough to pass 100% through a 325 mesh screen, have a medium particle size of 3–6 um and a bulk density of about 0.4 g/cm$^3$.

7. The heavy duty lubricating grease of claim 6, wherein the lubricating grease is in the National Lubricating Grease Institute class number 1, has a dropping point in excess of 500° F., and employs a hydrocarbonaceous oil with a Saybolt Universal Seconds viscosity at 100° F. of about 600, so as to be useful in bits drilling in hot subterranean formations.

8. A method of manufacturing an earth boring drill bit of the type having a bearing pin extending from a head section of the drill bit for rotatably mounting a cutter, comprising the steps of:

carburizing an external region of the bearing pin;

carburizing an internal region of the cutter; and lubricating the region of contact between the external region of the baring pin and the internal region of the cuter with a heavy duty lubricating grease, the grease comprising;

a multi-purpose heavy duty hydrocarbonaceous lubricant thickened by an alkaline soap to form a lubricating grease;

powdered molybdenum disulfide present in the range from about 1–20% by weight of the grease; and powdered calcium fluoride present in the range from about 1–20% by weight of the grease, the weight percent ratio of powdered molybdenum disulfide to powdered calcium fluoride being in the range from about 1:6 to 6:1.

* * * * *